US007824153B2

(12) United States Patent
Akimoto et al.

(10) Patent No.: US 7,824,153 B2
(45) Date of Patent: Nov. 2, 2010

(54) STATOR VANE OF TURBO MOLECULAR PUMP

(75) Inventors: Takeshi Akimoto, Chiba (JP); Shinji Kawanishi, Chiba (JP)

(73) Assignee: BOC Edwards Japan Limited (JP)

( * ) Notice: Subject to any disclaimer, the term of this patent is extended or adjusted under 35 U.S.C. 154(b) by 846 days.

(21) Appl. No.: 11/662,229

(22) PCT Filed: Aug. 26, 2005

(86) PCT No.: PCT/JP2005/015518

§ 371 (c)(1),
(2), (4) Date: Mar. 8, 2007

(87) PCT Pub. No.: WO2006/027961

PCT Pub. Date: Mar. 16, 2006

(65) Prior Publication Data

US 2008/0118351 A1 May 22, 2008

(30) Foreign Application Priority Data

Sep. 10, 2004 (JP) ..... 2004-264426

(51) Int. Cl.
*F01D 9/04* (2006.01)

(52) U.S. Cl. ..... 415/191; 415/199.5; 415/211.2

(58) Field of Classification Search ..... 415/90, 415/299.5, 191, 211.2, 139, 199.5
See application file for complete search history.

(56) References Cited

U.S. PATENT DOCUMENTS 2,971,333 A * 2/1961 Mendelsohn et al. ..... 60/787
5,158,426 A * 10/1992 Casaro et al. ..... 415/52.1
5,466,119 A 11/1995 Boivin et al. ..... 415/90
6,334,754 B1 1/2002 Kabasawa ..... 415/90
2003/0223859 A1* 12/2003 Carboneri et al. ..... 415/90
2004/0033130 A1* 2/2004 Blumenthal et al. ..... 415/90

FOREIGN PATENT DOCUMENTS

DE 19937393 2/2001

* cited by examiner

*Primary Examiner*—Ninh H Nguyen
(74) *Attorney, Agent, or Firm*—Adams & Wilks

(57) ABSTRACT

A stator vane for a turbo molecular pump has stator vane halves each having inner and outer rim portions and radially arranged stator blades connected integrally between the inner and outer rim portions. The inner rim portion of each stator vane half has a pair of inner rim ends and the outer rim portion of each stator vane half has a pair of outer rim ends. The stator vane halves are disposed in abutment with one another along an abutment line to form an annular body with the inner rim ends of one of the stator vane halves being disposed in confronting relation with the respective inner rim ends of the other of the stator vane halves and with the outer rim ends of the one of the stator vane halves being disposed in confronting relation with the respective outer rim ends of the other of the stator vane halves. At least each of the inner rim ends or each of the outer rim ends of one of the two stator blade halves being formed shorter in a circumferential direction of the annular body with respect to the abutment line to form a gap between the confronting inner rim ends or the confronting outer rim ends.

20 Claims, 6 Drawing Sheets

(PROCESS 2)

(PROCESS 3)

STATOR VANE OF TURBO MOLECULAR PUMP

CROSS-REFERENCE TO RELATED APPLICATIONS

This application is a U.S. national stage application of International Application NO. PCT/JP2005/015518, filed Aug. 26, 2005, claiming a priority date of Sep. 10, 2004, and published in a non-English language.

BACKGROUND OF THE INVENTION

1. Technical Field

The present invention relates to a stator vane of a turbo molecular pump and particularly to the reduction of breakage of the stator vane.

2. Background Art

A vacuum pump has, in general, a rotor rotatably installed inside a pump case and by high-speed rotation of this rotor, rotor vanes integrally cut out in a number of stages around the rotor are also rotated at a high speed. On the inner periphery of the pump case, stator vanes and the rotor vanes are alternately arranged in a number of stages.

By interaction of the stator vanes and the rotor vanes arranged alternately in a number of stages, exhaust action of a gas molecule is carried out, and a process chamber or the like of a semiconductor device to which this vacuum pump is connected is brought into a vacuum state. That is, the rotor vane on the uppermost stage rotating at a high speed imparts a downward motion to a gas molecule having entered from a gas inlet, and the gas molecule having the downward motion is guided to the stator vane and fed into the rotor vane on the subsequent stage. By repeated operation of the above imparting of the motion to the gas molecule and feeding it in many stages, the gas molecule on the gas inlet side is sequentially transferred to the inside of a screw stator below a rotor and exhausted, by which the inside of the process chamber or the like of the semiconductor device is made vacuum.

An interval between the stator vane and the rotor vane performing the above exhaust operation of the gas molecule is set extremely small so that the gas molecule can be exhausted efficiently.

The stator vane is arranged radial in plural between an inner rim portion 32 and an outer rim portion 33 as shown in FIG. 7A, for example, and arranged in a vacuum pump as a stator vane B in the integrally connected state. Also, the stator vane B is generally positioned and fixed in many stages alternately with the rotor vane through a spacer on the inner circumference of the pump case by holding the outer rim portion 33.

As mentioned above, the stator vanes B are arranged alternately with the rotor vanes in many stages, and the stator vane shape is a ring and the rotor vanes are integrally cut out in many stages around the rotor. Thus, it is not possible to arrange them in the vacuum pump by placing the center hole portions of the ring-shaped stator vanes B over the rotors. Therefore, this stator vane B needs to be divided before being arranged in the vacuum pump.

For example, this type of stator vane B is in a construction that two stator vane halves 30, provided respectively with an inner rim portion 32, the outer rim portion 33, and a plurality of stator blades 31, 31 arranged radial between the inner rim portion 32 and the outer rim portion 33 as shown in FIG. 7B, are abutted to each other by a method as shown in FIGS. 7A and 7B to have the ring state. And the stator vane halves 30 are inserted respectively from both sides with the rotor between them and arranged in the vacuum pump alternately with the rotor vane by being combined in the ring state in the above method.

When abutting to arrange the two stator vane halves 30 between the rotor vanes, an inner rim end 32*a* and an outer rim end 33*a* are to be positioned in the ring shape. Since the rotor vane is integrally cut out as mentioned above and the outer rim portion 33 of the stator vane half 30 is positioned and stacked through the spacer, the abutted state of the inner rim end 32*a* can not be checked from the outside.

That is, when the stator vane half 30 in the semi-ring shape is to be positioned and arranged inside the vacuum pump, the positioning is carried out only by the outer rim end 33*a* capable of being visually checked from the outside, while the inner rim end 32*a* is positioned and arranged without visual check in general.

This stator vane half 30 in the same semi-ring shape is manufactured in plural from the viewpoint of cost reduction, work efficiency and the like using a punching press or the like (Patent Document 1).

Therefore, when the two stator vane halves 30 are abutted to each other as in FIG. 7A, the inner rim end 32 and the outer rim end 33*a* of each of the stator vane half 30 should be also abutted to each other and positioned on an abutment line L. However, there is a variation in manufactured stator vane half 30 and the inner rim end 32*a* might be formed longer in the circumferential direction than a design dimension with respect to the abutment line L at the punching press.

If one or two of such defectively manufactured stator vane halves 30 are abutted as above and positioned/arranged in the vacuum pump, since the abutted state of the inner rim ends 32*a* cannot be checked, the inner rim ends 32*a* might collide with each other and overlap each other or be warped as shown in FIGS. 9A and 9B, which leads to the following problem.

That is, the interval between the stator blade 31 and the rotor vane is set extremely small as mentioned above. Thus, if the overlap or warping as shown in FIGS. 9A and 9B occurs in the inner rim end 32*a*, the interval is further narrowed, and the overlapping or warped portion might contact the rotor vane and result in breakage of the stator blade 31 in the end.

Prevention of a cause of such breakage of the stator blade 31 is particularly important in terms of ensuring of safety and avoidance of danger, but with such a construction as described in Patent Document 2 that the stator vane B formed by abutting the two stator vane halves 30, that is, a construction of the fixed vane B formed by abutting the two stator vane halves 30 manufactured so that the inner rim ends 32*a* and the outer rim ends 33*a* are located on the abutment line L, the breakage in the stator blade 31 caused by the overlap or warping of the inner rim end 32*a* can not be prevented and as a result, the breakage in the stator blade 31 can not be reduced.

Patent Document 1: Japanese Patent Laid-Open No. 2003-269365

Patent Document 2: Japanese Patent Laid-Open No. 5-157090

The present invention was made in order to solve the above problem and has an object to provide a stator vane of a turbo molecular pump suitable for reduction of breakage in a stator vane.

SUMMARY OF THE INVENTION

In order to achieve the above object, the present invention is a stator vane of a turbo molecular pump formed annular by abutting a pair of stator vane segments or halves, each having a plurality of stator blades arranged radially and connected integrally by an inner rim portion and an outer rim portion, the stator vane having a gap at the abutment portion of the inner rim portion.

This stator vane half is manufactured in plural as the same semi-ring shape through profile punching, slit cutting, and bending, for example, and the ring-shaped turbo molecular stator vane is constructed by abutting these two stator vane halves to each other.

Also, since one end of an inner rim end of this stator vane half is formed shorter in the circumferential direction from an abutment line, the inner rim ends do not collide with each other when the two stator vane halves are abutted to each other, and a gap is formed in the inner rim portion of the ring-shaped stator vane formed by abutting these two stator vane halves.

In the present invention, the gap may be 0.3 mm to 0.7 mm. This gap needs to be an interval to such an extent that the inner rim ends do not overlap or are warped at an abutment portion when the two stator vane halves are abutted and the gap is more preferably 0.5 mm.

Also, this gap is formed by making one end of the inner rim end of the stator vane half shorter in the circumferential direction from the abutment line formed by abutting the two stator vane halves, and this inner rim end may be an end on the cut-and-raised side of the inner rim portion.

If the end on the cut-out terminal end of the inner rim end is formed shorter, a portion for holding the stator blade by the inner rim portion is cut and there is a fear that holding strength of the stator blade is lowered, and thus the above method is preferable.

In the present invention, the construction that the gap is formed in the inner rim portion in the state that the two stator vane halves are abutted together. Thus, since occurrence of the overlap or warping in the inner rim portion can be prevented when the stator vane is arranged in the vacuum pump, breakage of the stator vane can be prevented, and the stator vane which can reduce breakage of the stator vane can be obtained.

DETAILED DESCRIPTION OF THE PREFERRED EMBODIMENTS

A best mode for carrying out the present invention will be described below in detail referring to the attached drawings.

A vacuum pump shown in FIG. 1 is used as a part of a vacuum device in a semiconductor manufacturing apparatus or a liquid-crystal display panel manufacturing apparatus so as to bring a pressure in a vacuum chamber to a predetermined vacuum degree. Also, the vacuum pump in the same figure is a complex-type vacuum pump in which a turbo molecular pump and a screw groove pump are combined and constructed to have a rotor 9 rotatably arranged in a cylindrical pump case 1, in which a substantially upper half of the rotor 9 functions as a turbo molecular pump, while the substantially lower half of the rotor 9 functions as a screw groove pump.

This pump case 1 is in a cylindrical case structure with a bottom having an opening on its upper face as a gas inlet 2 and an exhaust pipe as a gas outlet 3 is projected on one side at the lower part. Also, the bottom part of the pump case 1 is covered by an end plate 4 and at the center on the inner bottom face, a stator column 5 is provided.

At the center part of this stator column 5, a rotor shaft 7 is rotatably provided, and this rotor shaft 7 is supported by magnetic bearings made from a radial electromagnet 6-1 and an axial electromagnet 6-2 provided in the stator column 5 in the axial direction and the radial direction, respectively.

A driving motor 8 is arranged inside the stator column 5, and this driving motor 8 is constructed to have a stator 8*a* in the stator column 5 and a rotor 8*b* arranged at the rotor shaft 7 so that the rotor shaft 7 is rotated around the shaft.

Inside the pump case 1, to an upper projecting end from the stator column 5 of the rotor shaft 7, the rotor 9 with a sectional shape covering the outer periphery of the stator column 5 is connected.

On the upper outer circumference of the rotor 9, rotor vanes 10 are arranged and fixed in many stages, and stator blades 31 are arranged and fixed in many stages alternately with the rotor vanes 10.

Also, a gap between the stator blades 31 in each stage is set at a predetermined distance and positioned and fixed in the cylindrical radial direction of the pump case 1.

Gap setting and radial positioning of the stator blade 31 in each stage are performed by a ring-shaped spacer 60 stacked in many stages on the inner circumference side of the pump case 1.

This spacer 60 is constructed so that the upper and the lower spacers 60, 60 are fitted to each other in the state where the spacers 60 are stacked in stages in order to prevent lateral displacement of the spacer 60 in spacer stacking work in a pump assembling process and to enable positioning of the upper and the lower spacers 60, 60 in the cylindrical radial direction of the pump case 1 in the same way.

Specifically, as shown in FIG. 2, such a stacking/fitting structure is employed for this spacer 60 that step portions 61*a*, 61*b* are formed on both the inner and the outer circumferential faces of each spacer 60, and the step portion 61*a* on the upper inner circumferential face and the step portion 61*b* on the lower outer circumferential face are fitted with each other.

Action of the above constructed vacuum pump will be described. First, an auxiliary pump, not shown, connected to the gas outlet 3 is operated to bring the inside of the chamber 14 to a vacuum state to some degree, the driving motor 8 is operated and then, the rotor shaft 7, the rotor 9 connected to that and the rotor vane 10 are rotated at a high speed.

The rotor vane 10 on the uppermost stage rotating at the high speed applies a downward motion to a gas molecule entering from the gas inlet 2, and the gas molecule having this downward motion is guided to the stator blade 31 and Then, fed to the rotor vane 10 side on the subsequent stage. By repeating the above application of the motion to the gas molecule and the feeding operation in many stages, the gas molecule on the gas inlet 2 side is sequentially transferred to the inside of the screw stator 12 below the rotor 9 and exhausted. That is, an exhaust operation of the gas molecule is carried out by interaction between the rotor vane 10 and the stator blade 31.

Moreover, the gas molecule which has reached the screw stator 12 below the rotor 9 by the above molecular exhaust operation is compressed from a transit flow to a viscous flow and transferred to the gas outlet 3 side by the interaction between the rotating rotor 9 and a screw groove 13 formed on the inside of the screw stator 12 and exhausted to the outside from this gas outlet 3 through the auxiliary pump, not shown.

Next, one embodiment of the stator vane according to the present invention will be described using FIGS. 3 to 8.

Since the stator vane B according to the present invention is constructed by abutting the two stator vane segments or halves 30 to each other, one embodiment of a manufacturing method of this stator vane half 30 will be described first.

First, as shown by a dotted line in FIG. 3 (process 1), a punching of a semi-ring plate material 101 from a plate material 100 is carried out (profile punching). For this profile punching process, a punching press can be applied.

At this profile punching, a cutout is made at one end of an inner-rim end forming portion 101-1. By this, in the state where the two stator vane halves 30 manufactured through the above and the following processes are abutted to each other, a gap S is formed at the inner rim portion 32 as shown below.

After that, as shown by a dotted line in FIG. 4 (process 2), a machining for forming a slit 102 in the semi-ring plate material 101 is carried out (slit cutting). For this slit cutting, the punching press can be also applied.

The above slit 102 is made in two in and out in the circumferential direction of the semi-ring plate material 101 and in a large number in the radial direction of the semi-ring plate material 101, but a plate-material portion 103-1 between the large number of radial slits 102-1, 102-1 finally becomes the stator blade 31 shown in FIG. 7B.

Also, in the above inner and outer two circumferential slits 102-2, 102-3, the plate-material portion 103-2 inside the inner circumferential slit 102-2 and the plate-material portion 103-3 outside the outer circumferential slit 102-3 become, as shown in FIG. 7B, the inner rim portion 32 and the outer rim portion 33 supporting the stator blade 31 (plate-material portion 103-1). Since the stator vane half 30 is constructed so that the stator blades 31 in the same shape are arranged repeatedly, only about one third of the stator vane half 30 is shown with the remaining two thirds omitted in FIG. 4.

Next, bending (process 3) is carried out. In this bending, the above plate-material portion 103-1 between the radial slits 102-1, 102-1 is bent so as to be raised upward with a given elevation angle θ, that is, an optimal angle for exhaust of the gas molecule as shown in FIG. 5.

For this bending, press bending as shown in FIG. 6 can be used, for example. The press bending in the figure is a bending in a method that opposed surfaces 200*a*, 201*a* of an upper and a lower punch 200, 201 are used as inclined press surfaces corresponding to an elevation angle θ of the stator blade 31, and the plate-material portion 103-1 between the radial slits 102-1, 102-1 is pressed from both face sides by these press surfaces in the order of (a), (b) and (c) as shown in FIG. 6.

After the profile punching (process 1), the slit cutting (process 2) and the bending (process 3) are completed, a plurality of the stator blades 31 are obtained as integrally arranged radial as shown in FIG. 7B and an integral part of the plurality of stator blades 31, 31 becomes a stator vane half 30 in this embodiment.

In this embodiment, one end of the inner rim end 32*a* of the stator vane half 30 manufactured through the above processes is formed shorter in the circumferential direction with respect to the abutment line L.

By this construction, when the two stator vane halves 30 are abutted to each other, a gap S is formed at the inner rim portion 32, which can prevent the above-mentioned overlap or warping at the inner rim portion 32 and reduce breakage of the stator vane B.

Next, one embodiment for arranging the stator vane half 30 manufactured as above in the vacuum pump will be described using FIGS. 1, 7 and 8. FIG. 7 is a view showing processes by which the ring-shaped stator vane B is formed by abutting the two stator vane halves 30 to each other, as conventional, and FIG. 8 is an enlarged view of A part and B portion in FIG. 7, that is, an enlarged view of an abutted part of the stator vane half 30.

Using two of the manufactured stator vane halves 30, each two of the stator vane halves 30 are arranged in the vacuum pump in the state where they are inserted from both sides, surrounding the rotor 9, between each pair of the rotor vanes 10 formed integrally in plural and many stages around the rotor 9.

The way to abut each of the stator vane halves 30 to each other when they are inserted and arranged is similar to the conventional way as shown in FIGS. 7A and 7B. Moreover, it is also similar to the conventional way in the point that each of the stator vane halves 30 is positioned to be in the ring shape when being abutted, and it is carried out only by the abutment state of the outer rim end 33*a* which can be visually checked from outside.

However, in the present invention, since a cutout is formed on each of the abutted stator vane halves 30 at one end of the inner-rim end forming portion 101-l at the above-mentioned profile punching as shown in FIG. 3, the one end of the inner rim end 32*a* of each of the stator vane halves 30 is formed shorter in the circumferential direction with respect to the abutment line L as shown in FIG. 8.

Therefore, in the present invention, as shown in FIG. 7A, when the stator vane halves 30 are abutted to each other, the gap S is formed in the inner rim portion 32 as shown in FIG. 8 at the A part and the B part in FIG. 7A, that is, the abutment portion of the stator vane half 30.

In this way, since the gap S is formed at the inner rim portion 32 of the stator vane B in the present invention, even if the positioning of each of the stator vane halves 30 is carried out by visually checking only the abutted state of the outer rim ends 33*a* and not visually checking the abutted state of the inner rim ends 32*a* at all, the inner rim ends 32*a* of each of the stator vane halves 30 do not collide with each other, and overlap or warping between the inner rim ends 32*a* does not occur.

The gap S is formed by making cutout at the inner rim end 32*a*. This cutout maybe preferably formed at a blade edge cut-and-raised side end 32*a*-1 of the inner rim portion 32 as shown in FIG. 8 rather than the cutout terminal end 32*a*-2 of the inner rim portion 32.

If a cutout is made at the cutout terminal end 32*a*-2, a portion of the inner rim 32 for holding the stator blade 31 is cut, and there is a fear that the holding strength of the stator blade 31 is lowered.

Also, if this gap S is too large, that obstructs stability and causes rattling when the stator vane B is rotated. Thus, it may be an interval to such an extent that no overlap or warping is caused in the state where the two stator vane halves 30 are abutted to each other, and the inventor has confirmed in experiments that the gap S is preferably 0.3 to 0.7 mm or more preferably 0.5 mm.

DESCRIPTION OF SYMBOLS

Figure 1:
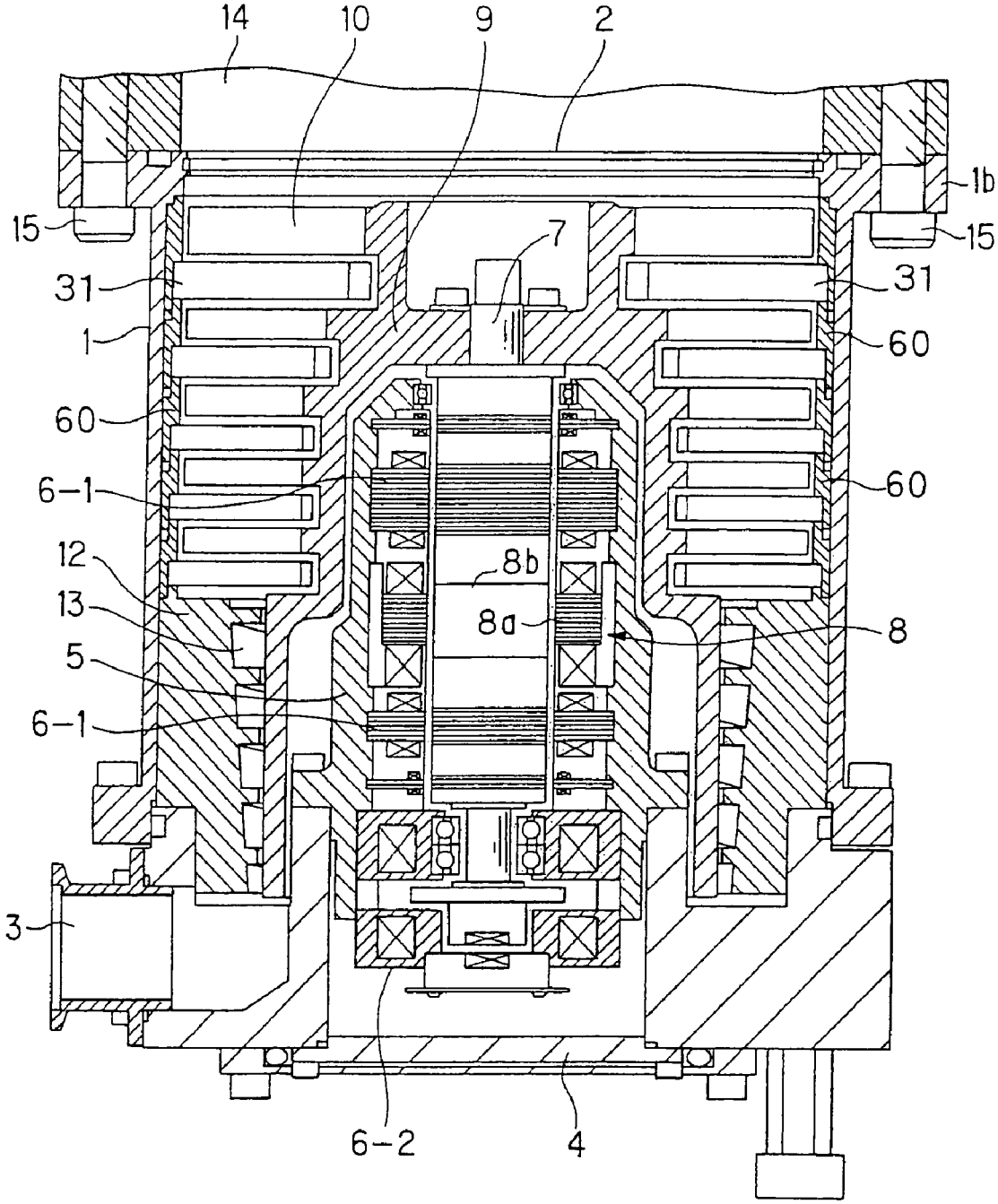
FIG. 1 is a sectional view of a vacuum pump.
Figure 2:
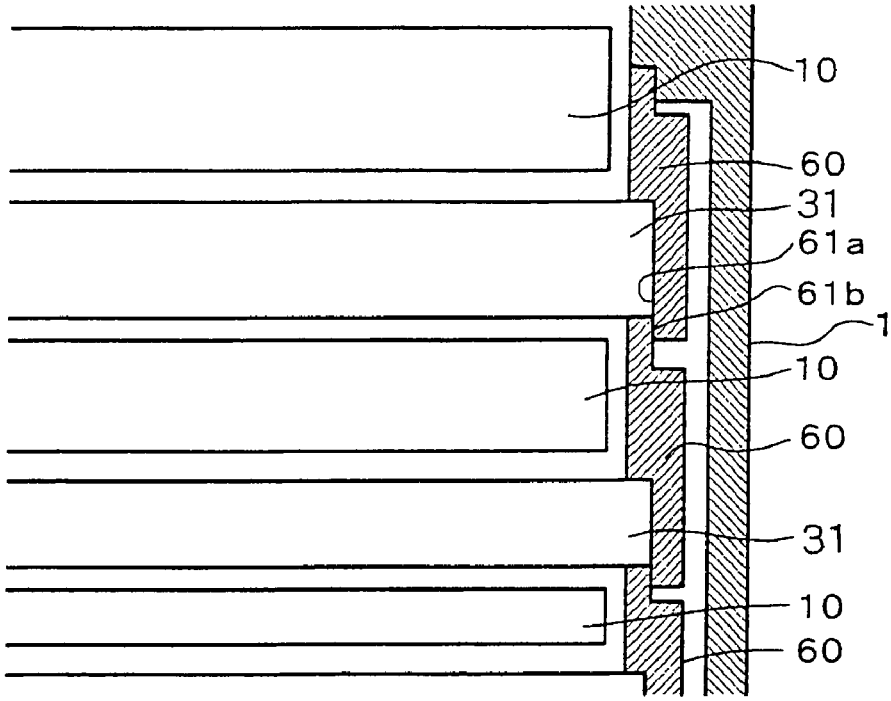
FIG. 2 is an enlarged view of a periphery of a spacer in the vacuum pump shown in FIG. 1.
Figure 3:
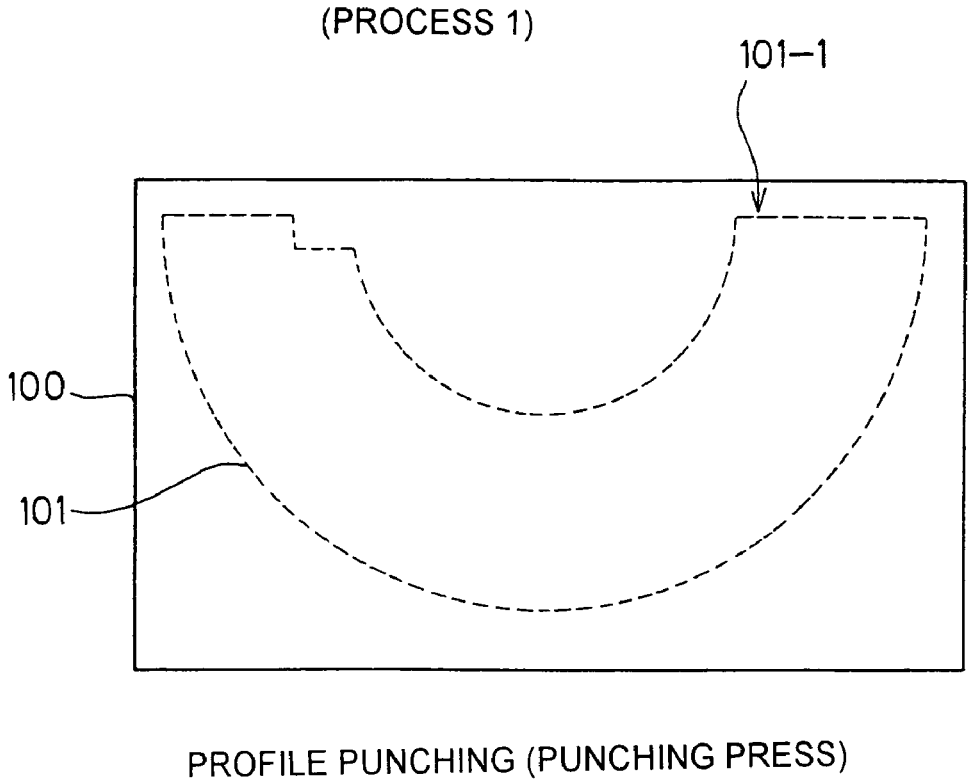
FIG. 3 is an explanatory view of a process for manufacturing a stator vane half (process 1)
Figure 4:
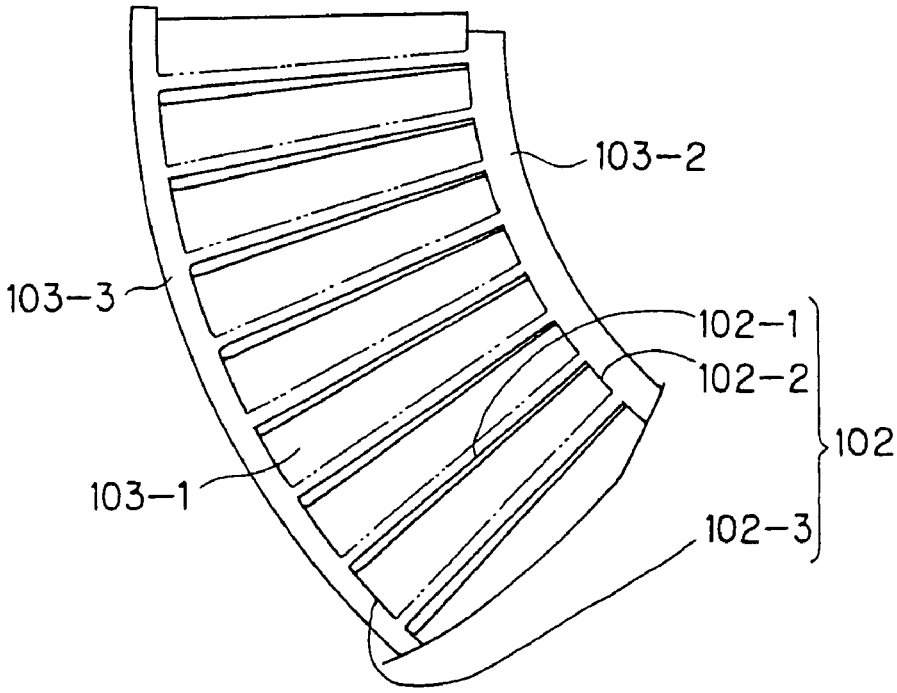
FIG. 4 is an explanatory view of a process for manufacturing a stator vane half (process 2)
Figure 5:
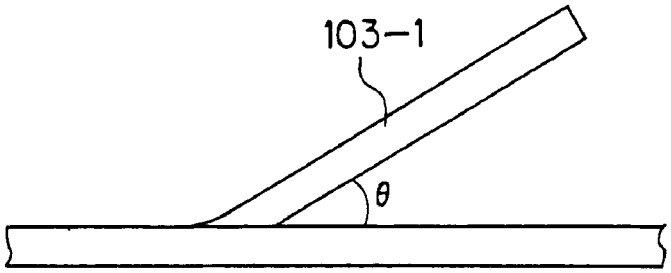
FIG. 5 is a view showing a state of a stator blade seen from the side after bending.
Figure 6:
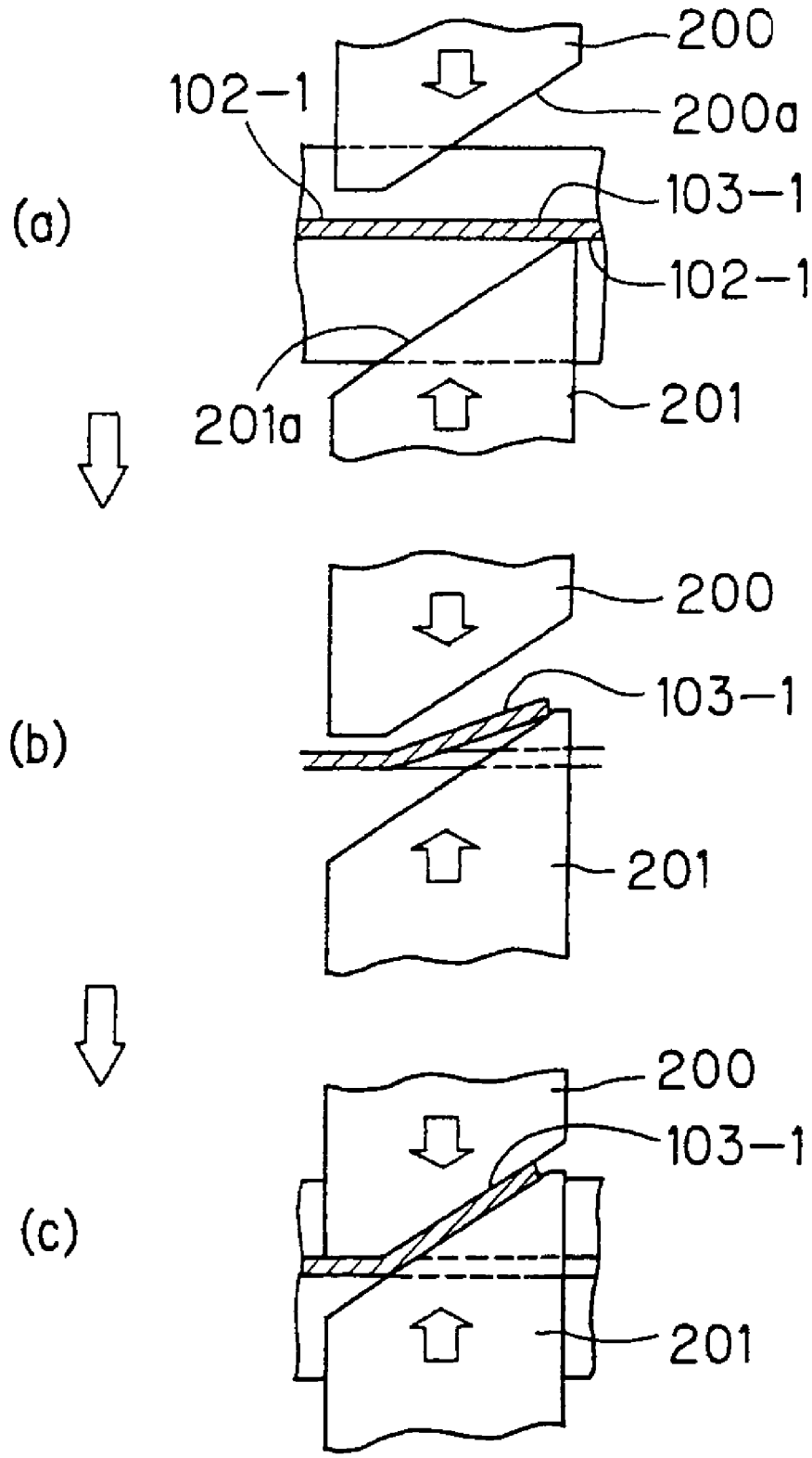
FIG. 6 is an explanatory view of a process for manufacturing a stator vane half (process view)
Figure 7:
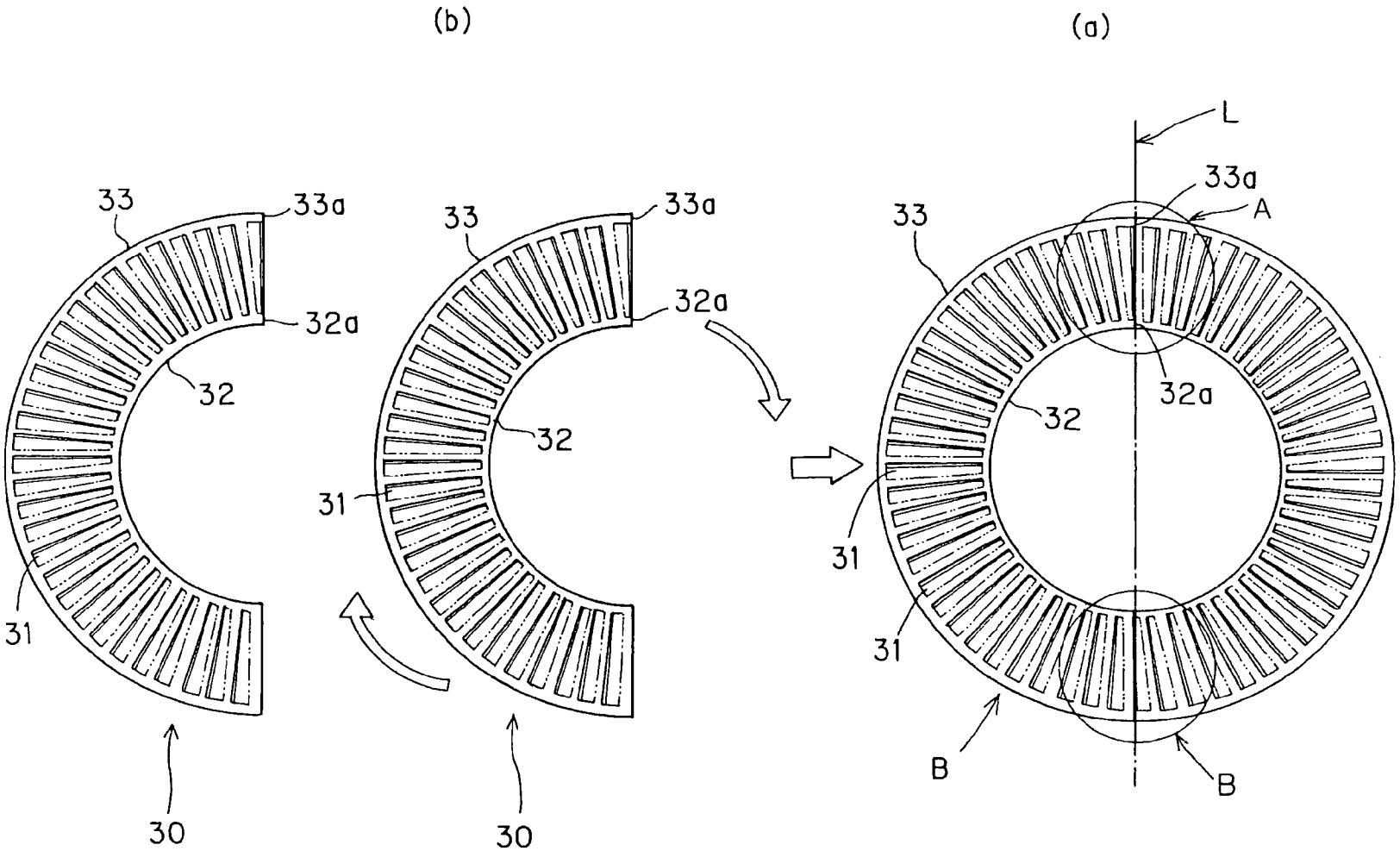
FIG. 7 is an assembled view of a stator vane.
Figure 8:
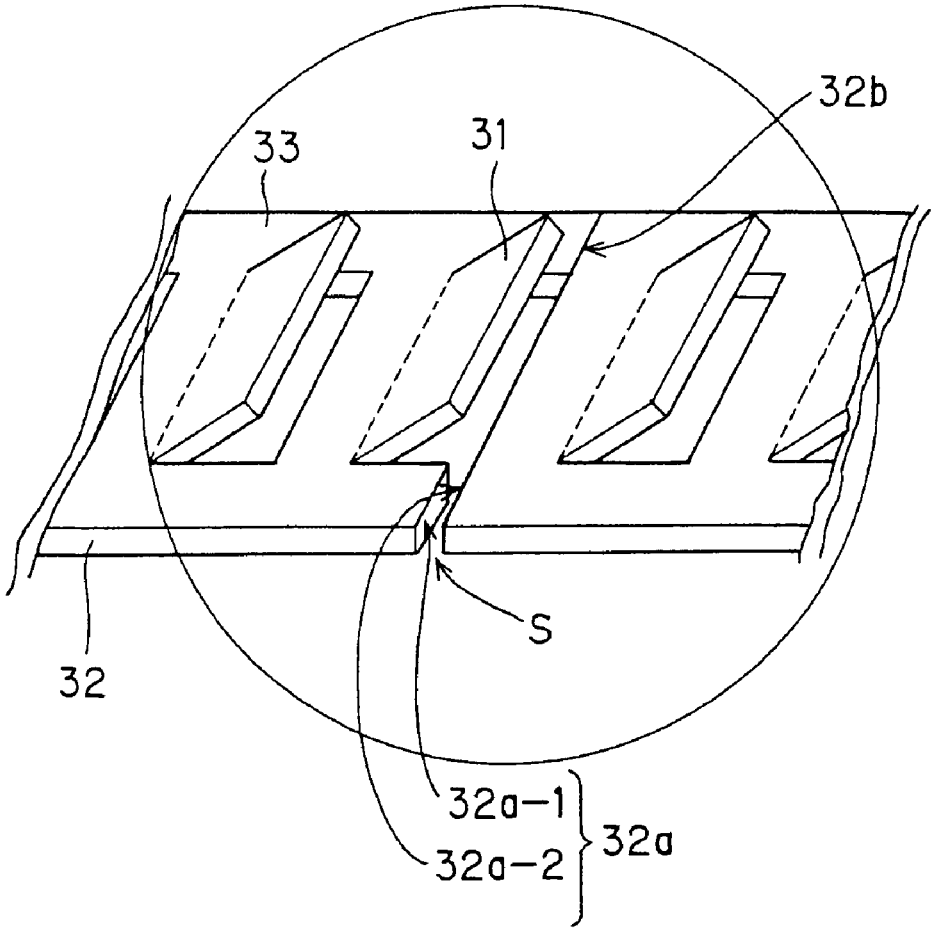
FIG. 8 is an enlarged view at an abutment portion in FIG. 7 of the stator vane according to the present invention.
Figure 9:
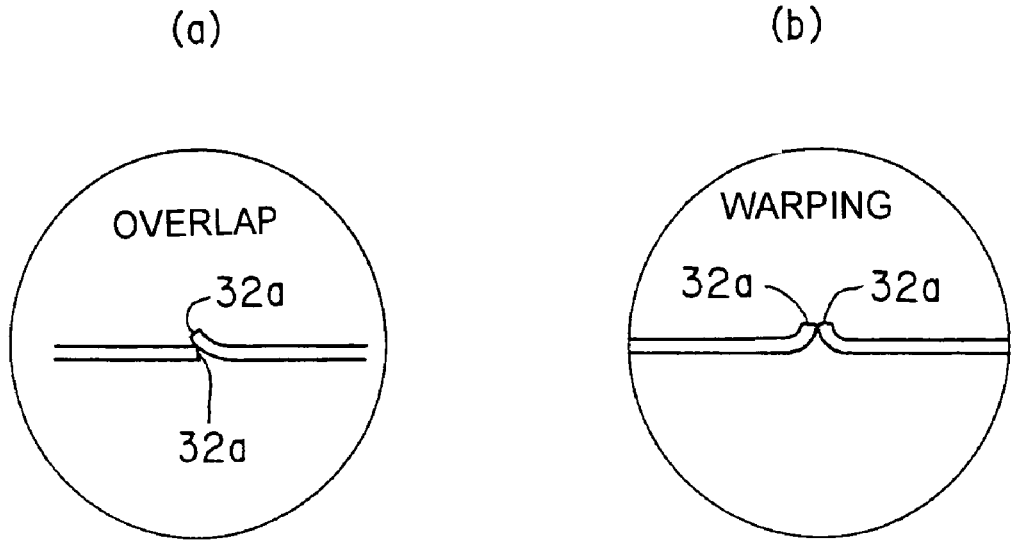
FIG. 9 is an enlarged view at an abutment portion in FIG. 7 of a conventional stator vane.

1 Pump case
2 Gas inlet
3 Gas outlet
4 End plate
5 Stator column
6-1 Radial electromagnet
6-2 Axial electromagnet
7 Rotor shaft
8 Driving motor
9 Rotor
10 Rotary vane
12 Screw stator
13 Screw groove
14 Chamber
30 Fixed vane aggregate
31 Fixed vane
32 Inner rim portion
**32*a*** Inner rim end
**32*a*-1** Cut-and-raised side end
**32*a*-2** Cutout terminal end
33 Outer rim portion
**33*a*** Outer rim end
60 Spacer
61 Step portion
100 Plate material
101 Semi-ring state plate material
101-1 Inner rim end forming portion
102 Slit
200 Punch
B Stator vane
L Abutment line
S Gap

The invention claimed is:

1. A stator vane for a turbo molecular pump, the stator vane comprising: two stator vane, halves each having inner and outer rim portions and a plurality of radially arranged stator blades connected integrally between the inner and outer rim portions, the inner rim portion of each stator vane half having a pair of inner rim ends and the outer rim portion of each stator vane half having a pair of outer rim ends, the stator vane halves being disposed in abutment with one another along an abutment line to form an annular body with the inner rim ends of one of the stator vane halves being disposed in confronting relation with the respective inner rim ends of the other of the stator vane halves and with the outer rim ends of the one of the stator vane halves being disposed in confronting relation with the respective outer rim ends of the other of the stator vane halves, at least each of the inner rim ends or each of the outer rim ends of one of the two stator blade halves being formed shorter in a circumferential direction of the annular body with respect to the abutment line to form a gap between the confronting inner rim ends or the confronting outer rim ends.

2. A stator vane for a turbo molecular pump according to claim 1; wherein the gap is in the range of 0.3 to 0.7 mm.

3. A stator vane for a turbomolecular pump according to claim 2; wherein the gap is 0.5 mm.

4. A stator vane for a turbo molecular pump according to claim 1; wherein the at least each of the inner rim ends or each of the outer rim ends has a cutout that forms the gap between the confronting inner rim ends or the confronting outer rim ends.

5. A stator vane for a turbo molecular pump according to claim 4; wherein the gap is in the range of 0.3 to 0.7 mm.

6. A stator vane for a turbomolecular pump according to claim 3; wherein the gap is 0.5 mm.

7. A vacuum pump having the stator vane of a turbo molecular pump according to claim 1.

8. A stator vane for a turbomolecular pump according to claim 1; wherein only each of the inner rim ends of each of the stator blade halves is formed shorter in a circumferential direction of the annular body with respect to the abutment line to form a gap between the confronting inner rim ends.

9. A stator vane for a turbo molecular pump according to claim 8; wherein the gap is in the range of 0.3 to 0.7 mm.

10. A stator vane for a turbomolecular pump according to claim 9; wherein the gap is 0.5 mm.

11. A stator vane for a turbo molecular pump according to claim 8; wherein each of the inner rim ends has a cutout that forms the gap between the confronting inner rim ends.

12. A vacuum pump having the stator vane of a turbo molecular pump according to claim 8.

13. A stator vane for a tubular molecular pump, the stator vane comprising:

a first stator blade segment having first inner and outer rim portions and a plurality of radially arranged stator blades connected integrally between the first inner and outer rim portions, the first inner rim portion having first inner rim ends and the first outer rim portion having first outer rim ends;

a second stator blade segment having second inner and outer rim portions and a plurality of radially arranged stator blades connected integrally between the second inner and outer rim portions, the second inner rim portion having second inner rim ends and the second outer rim portion having second outer rim ends, the second stator blade segment being configured for abutment with the first stator blade segment along an abutment line to form an annular body with the first inner rim ends being disposed in confronting relation with the respective second inner rim ends and with the first outer rim ends being disposed in confronting relation with the respective second outer rim ends; and means defining a gap between the confronting first and second inner rim ends or the confronting first and second outer rim ends when the first and second blade segments are disposed in abutment with one another.

14. A stator vane for a turbo molecular pump according to claim 13; wherein the means defining the gap comprises each of the first inner rim ends, each of the first outer rim ends, each of the second inner rim ends, or each of the second outer rim ends being formed shorter in a circumferential direction of the annular body with respect to the abutment line to form the gap between the confronting first and second rim ends or the confronting first and second outer rim ends.

15. A stator vane for a turbo molecular pump according to claim 14; wherein each of the first inner rim ends or each of the second inner rim ends are formed shorter in a circumferential direction of the annular body with respect to the abutment line to form the gap.

16. A stator vane for a turbo molecular pump according to claim 14; wherein each of the first outer rim ends or each of the second outer rim ends are formed shorter in a circumferential direction of the annular body with respect to the abutment line to form the gap.

17. A stator vane for a turbo molecular pump according to claim 13; wherein the means defining the gap comprises a cutout formed on each of the first inner rim ends or each of the second inner rim ends.

18. A stator vane for a turbo molecular pump according to claim 13; wherein the gap is in the range of 0.3 to 0.7 mm.

19. A stator vane for a turbomolecular pump according to claim 18; wherein the gap is 0.5 mm.

20. A vacuum pump having the stator vane of a turbo molecular pump according to claim 13.

* * * * *